US007017452B1

(12) United States Patent
Lin

(10) Patent No.: US 7,017,452 B1
(45) Date of Patent: Mar. 28, 2006

(54) RATCHET-BASED ADAPTOR ASSEMBLY

(75) Inventor: Wen-Hsu Lin, Taichung (TW)

(73) Assignee: Infinite Electronics Inc., (TW)

( * ) Notice: Subject to any disclaimer, the term of this patent is extended or adjusted under 35 U.S.C. 154(b) by 0 days.

(21) Appl. No.: 11/052,778

(22) Filed: Feb. 9, 2005

(51) Int. Cl.
*B25B 13/52* (2006.01)

(52) U.S. Cl. ..... 81/60; 81/15.7; 81/177.2

(58) Field of Classification Search ..... 81/15.7, 81/177.2, 63.2, 60, 584; 254/126
See application file for complete search history.

(56) References Cited

U.S. PATENT DOCUMENTS 4,092,012 A * 5/1978 Ishigami ..... 254/126
4,811,636 A * 3/1989 Okura ..... 81/63.2
5,005,448 A * 4/1991 Main ..... 81/63
5,950,990 A * 9/1999 Castillo ..... 254/126
6,334,605 B1 * 1/2002 Kikuchi ..... 254/126

* cited by examiner

*Primary Examiner*—Lee D. Wilson
*Assistant Examiner*—Alvin J Grant
(74) *Attorney, Agent, or Firm*—Bacon & Thomas, PLLC

(57) ABSTRACT

A ratchet-based adaptor assembly is comprised of a main body, a shell, a ratchet-like driven member, a switch member, and a spring. The shell is covered on the main body, having a neck formed at a side for connection with a wheel replacement wrench. A receiving space is defined between the main body and the shell. The ratchet-like driven member is rotatably mounted in the receiving space, having a plurality of teeth and an adaptor for connection with a rotatable joint of a jack. The switch member includes at least two teeth for engaging the teeth of the ratchet-based driven member, being pivotally mounted in the receiving space but having a part exposed outside the main body for poking by the user's hand. The spring is mounted in the receiving space so as to keep enabling the switch member to engage the driven member.

4 Claims, 6 Drawing Sheets

RATCHET-BASED ADAPTOR ASSEMBLY

BACKGROUND OF THE INVENTION

1. Field of the Invention

The present invention relates generally to jacks for jacking up cars, and more particularly, to a ratchet-based adaptor assembly for transitional connection between a jack and a wheel replacement wrench.

2. Description of the Related Art

Referring to FIG. 6, a conventional jack 70 for jacking up a car is comprised of a linkage 72, a screw rod 71 pivotally mounted through the linkage 72, and a rotatable joint 73 connected with the screw rod 71. The rotatable joint 73 includes two ears 74 extending outwards and respectively having a through hole 75 and a slot 76.

During operation of the jack 70, the user usually inserts a screwdriver 79 into the through hole 75 and the slot 76 and then manually rotate the screwdriver to drive the rotatable joint 73 to rotate together with the screw rod 71 so as to extend/retract the jack 70, thereby jacking up/down the car.

However, in the beginning, the jack 70 is low in elevation, so that the user would easily carelessly have the screwdriver 79 or the hand to rub the ground, interfering with operation of the jack 70 or even causing injury. In addition, since the moment of the force of the screwdriver for operating the jack 70 is little, operation of the jack 70 would be laborsome for users having little strength. Further, since the jack is low in elevation, it is hard to use a long hand tool of great moment of force upon the jack 70. Even if it is necessary to use the long hand tool of great moment of force, the user can only rotate the long hand tool inserted into one side of the jack 70 through a predetermined angle before having to remove the tool from the jack 70 and then insert the tool into the other side of the jack 70, to rotate the tool through a predetermined angle again, repeating the aforesaid steps for many times in an inconvenient manner.

SUMMARY OF THE INVENTION

The primary objective of the present invention is to provide a ratchet-based adaptor assembly, which enables transitional connection between a wheel replacement wrench and a jack and enables the user to use a wrench having a large moment of force for laborsaving and convenient operation rather than repetitive change of operational positions resulted from repetitive insertion and extraction of the wrench.

The foregoing objective of the present invention is attained by the ratchet-based adaptor assembly. The jack is comprised of a screw rod and a rotatable joint connected with the screw rod. The rotatable joint includes a slot. The screw rod includes a flat head at its one end. The ratchet-based adaptor assembly is comprised of a main body, a shell, a ratchet-like driven member, a switch member, and a spring. The main body includes a circular hole. The shell is covered on the main body, having a neck protruding outwards from an external side thereof and a rectangular socket recessed inwards from a top side of the neck. A receiving space is defined between the main body and the shell. The ratchet-like driven member is rotatably received in the circular hole of the main body, having a plurality of teeth formed at a periphery thereof, an adaptor mounted at one end thereof and extending though and out of the circular hole, a flat body formed on the adaptor, and a lug protruding outwards from one side of the flat body for wedging into the slot of the rotatable joint of the jack. The switch member includes at least two teeth for engaging the ratchet-based driven member, being pivotally mounted in the receiving space but having a part exposed outside the main body for poking by the user's hand. The spring is mounted between the main body and the switch member for generating resilience that keeps moving the switch member towards the ratchet-like driven member and enabling the switch member to engage the driven member.

DETAILED DESCRIPTION OF PREFERRED EMBODIMENTS

Figure 1:
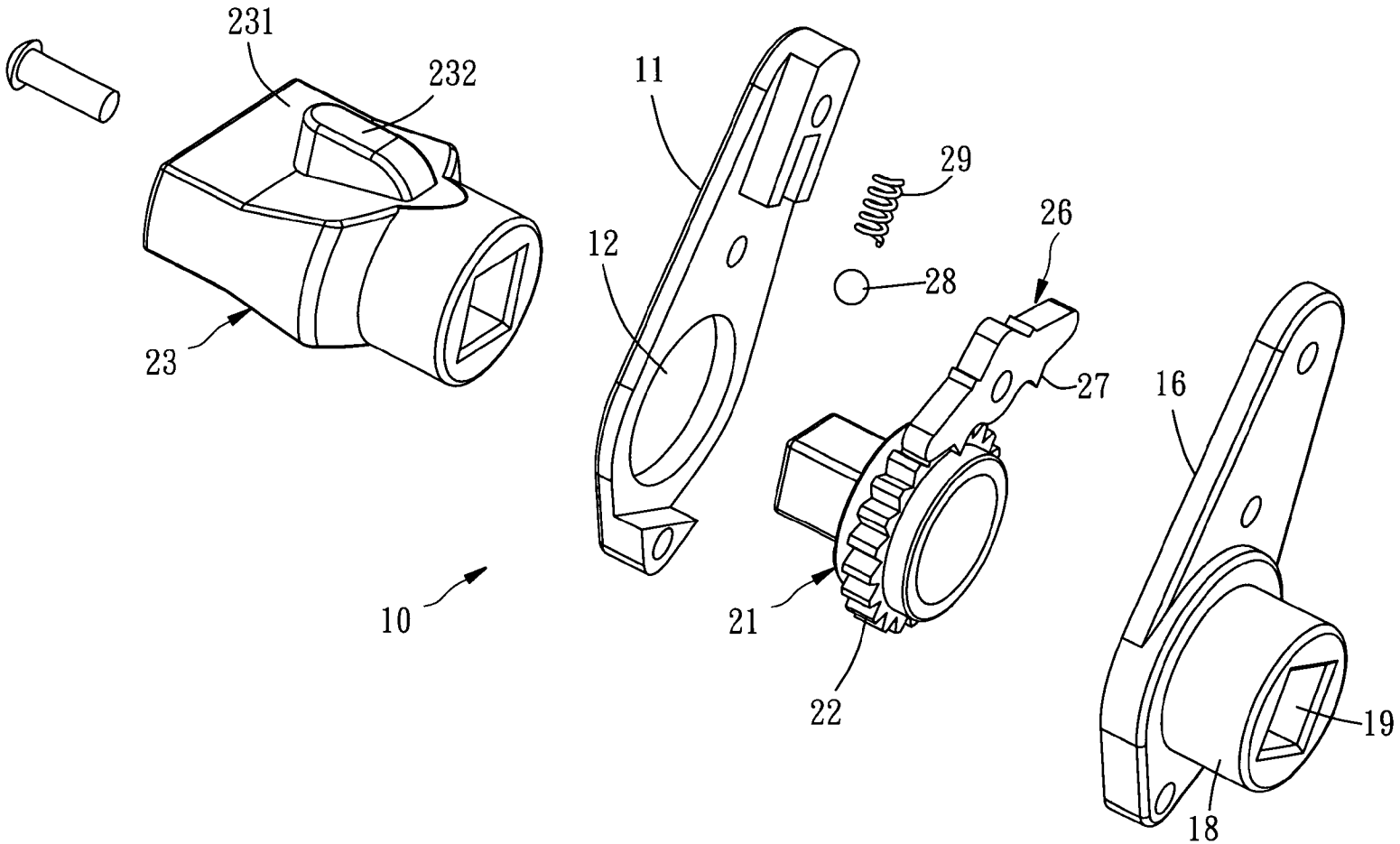
FIG. 1 is an exploded view of a first preferred embodiment of the present invention.
Figure 2:
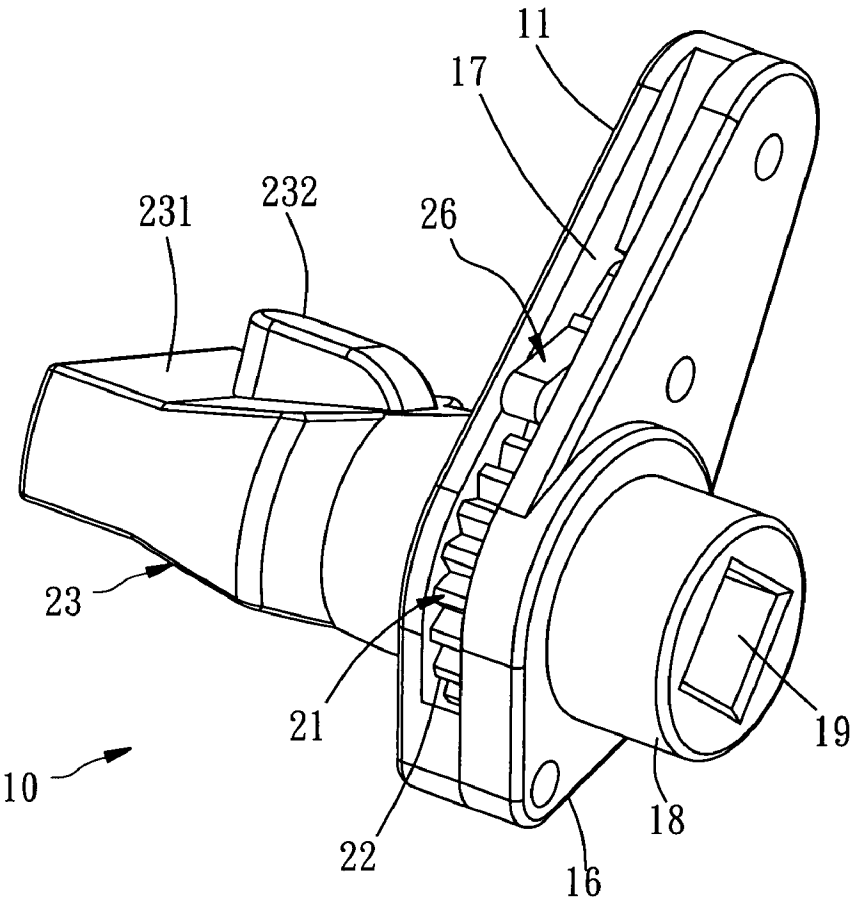
FIG. 2 is a perspective view of the first preferred embodiment of the present invention.
Figure 3:
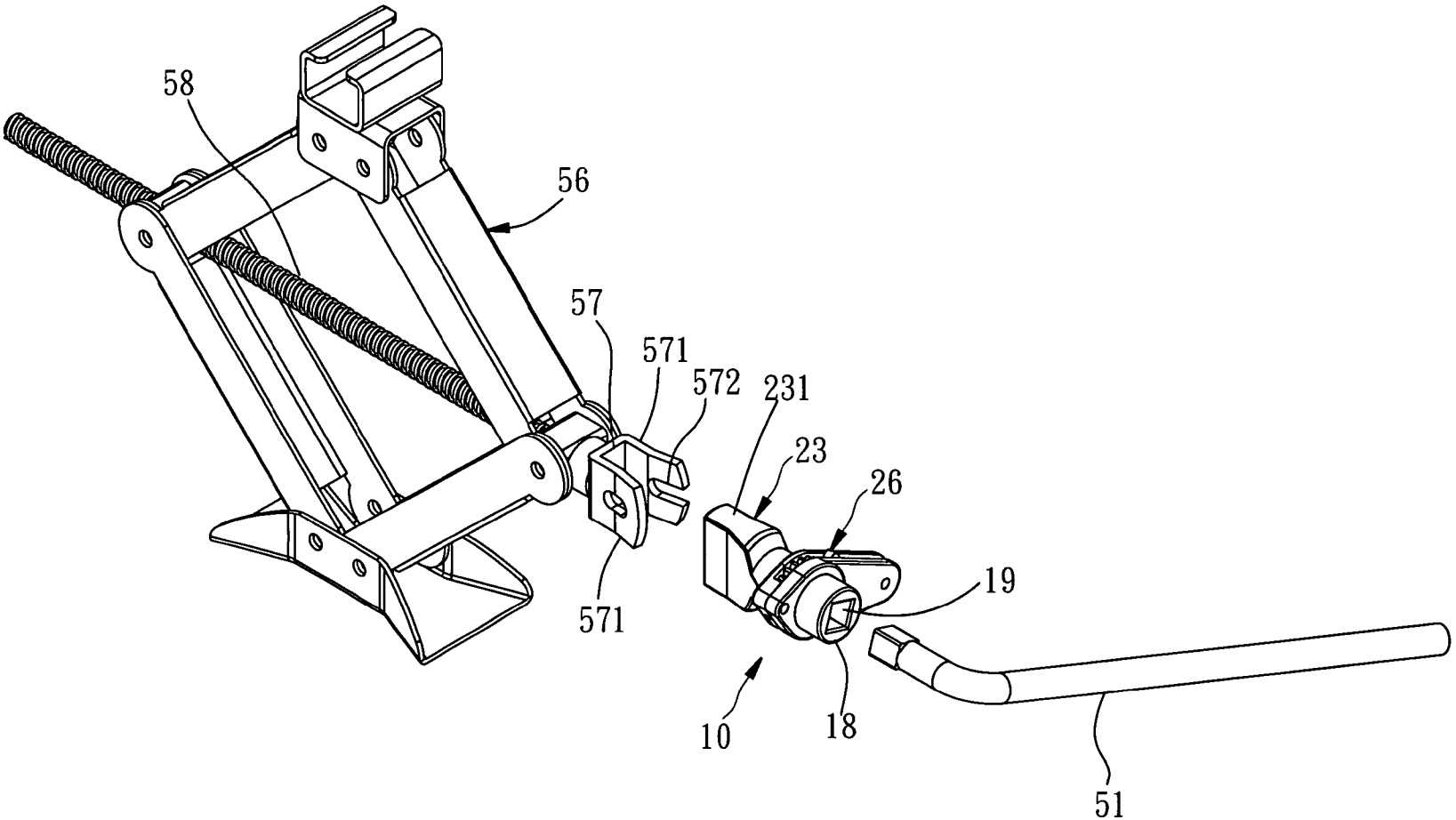
FIG. 3 is a schematic view of the first preferred embodiment of the present invention in operation.

Referring to FIGS. 1–3, a ratchet-based adaptor assembly 10 constructed according to a first preferred embodiment of the present invention for transitional connection between a wheel replacement wrench 51 and a jack 56. The jack 56 is structurally conventional to be well-known as prior art, including a screw rod 58 and a rotatable joint 57 connected with the screw rod 58. The rotatable joint 57 has two ears 571, one of which is provided with a slot 572. The ratchet-like adaptor assembly 10 is comprised of a main body 11, a shell 16, a ratchet-like driven member 21, a switch member 26, and a spring 29.

The main body 11 includes a circular hole 12.

The shell 16 is covered on the main body 11, having a neck 18 protruding outwards from an external side thereof. A receiving space 17 is defined between the main body 11 and the shell 16. The neck 18 is provided with a rectangular socket 19 recessed from a top side thereof for inserting a rectangular head of the wheel replacement wrench 51 for further operation.

The ratchet-like driven member 21 is rotatably mounted through the circular hole 12 and received in the receiving space. The ratchet-like driven member 21 includes a plurality of teeth 22 at a periphery thereof, and an adaptor 23 extending from an end thereof out of the circular hole 12. The adaptor 23 has a flat body 231 for being received between the two ears 571 of the rotatable joint 57 of the jack 56, and a lug 232 protruding outwards from a side of the flat body 231 for being wedged into the slot 572.

The switch member 26 includes two teeth 27 for engaging the teeth 22 of the driven member 21. The switch member 26 is pivotally mounted between the main body 11 and the shell 16 by means of a ball 28 and received in the receiving space 17. The switch member 26 has a part exposed outside the main body 11 accessible by the user's hand for operating the switch member 26.

The spring 29 is mounted between the main body 11 and the switch member 26 for generating resilience that keeps moving the switch member 26 towards the driven member 21 and to enable the switch member 26 to engage the driven member 21.

Referring to FIG. 3, the ratchet-based adaptor assembly 10 is connected with the jack 56 at the adaptor 23 thereof, wherein the flat body 231 is received between the two ears 571 and the lug 232 is wedged into the slot 572 of the rotatable joint 57; next, insert the rectangular head of the replacement wrench 51 into the rectangular socket 19 of the shell 16. Then, the user can turn the wrench 51, like operating a ratchet wrench, to drive the rotation of the rotatable joint 57 of the jack 57 through ratchet-based adaptor assembly 10 to jack up/down a car or a heavy object.

Figure 4:
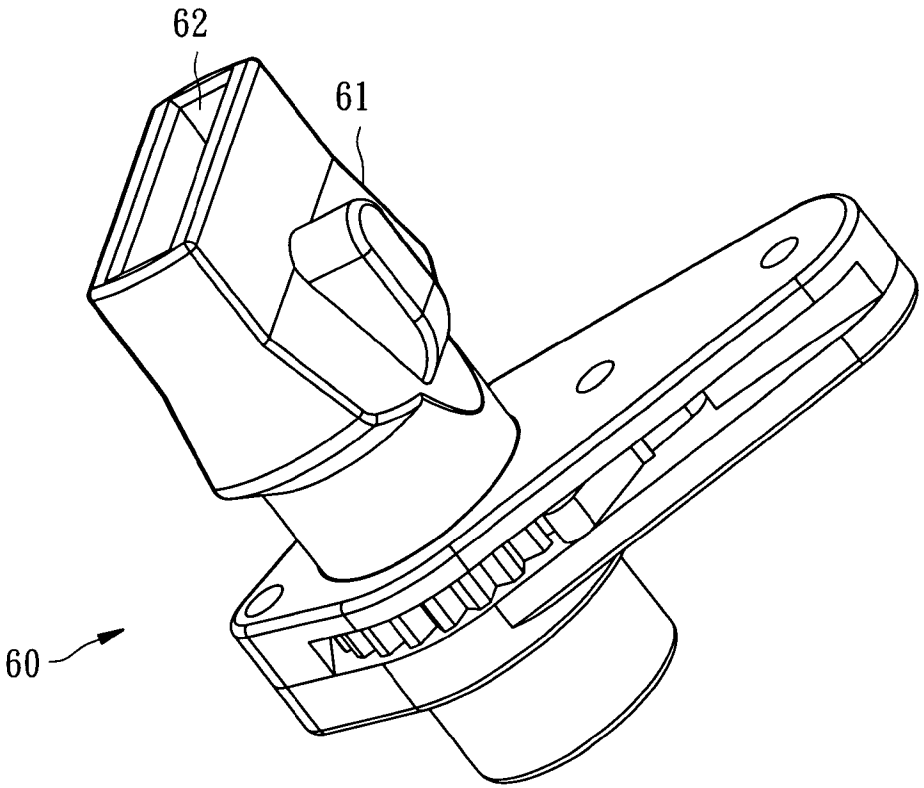
FIG. 4 is a perspective view of a second preferred embodiment of the present invention.
Figure 5:
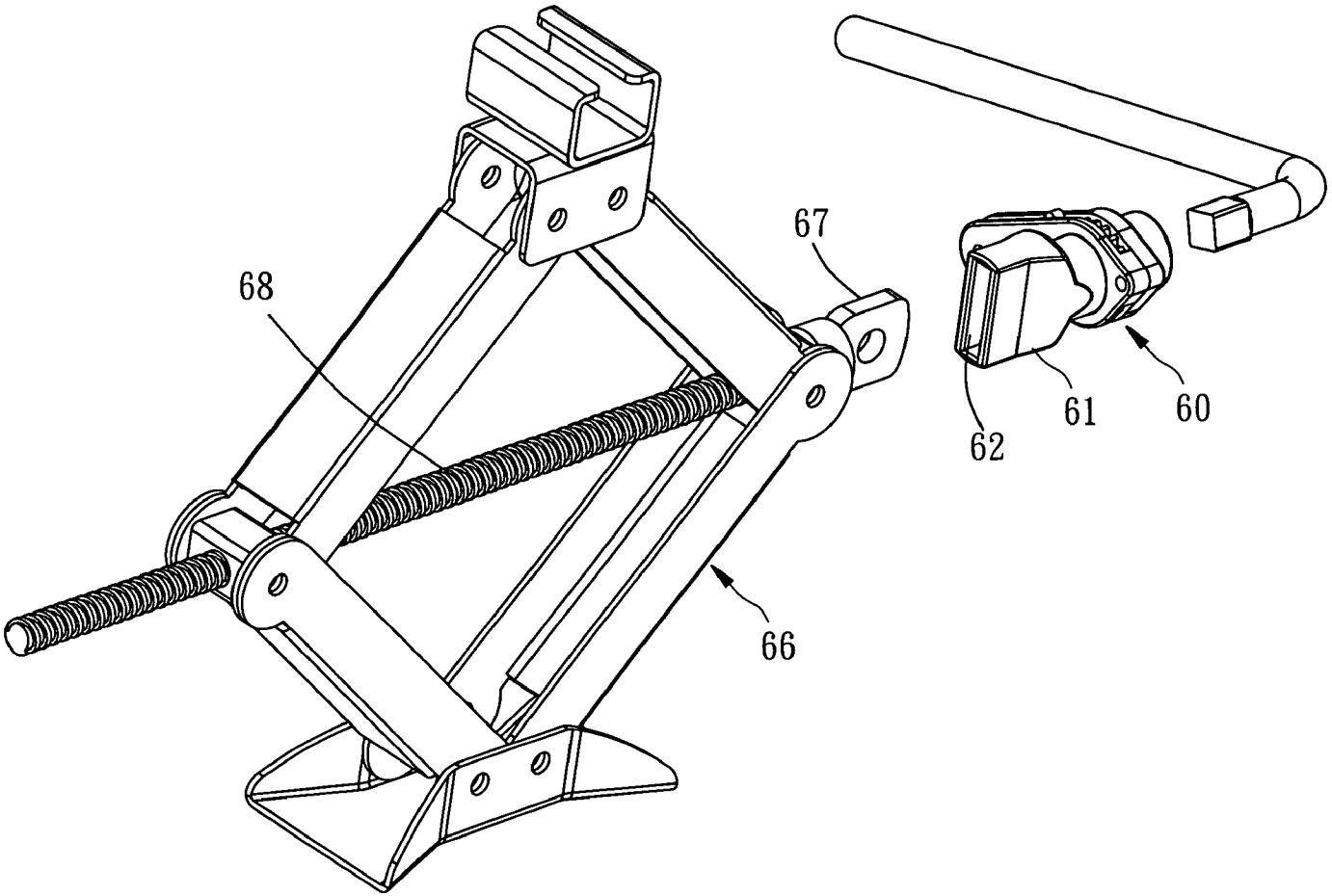
FIG. 5 is a schematic view of the second preferred embodiment of the present invention in operation.
Figure 6:
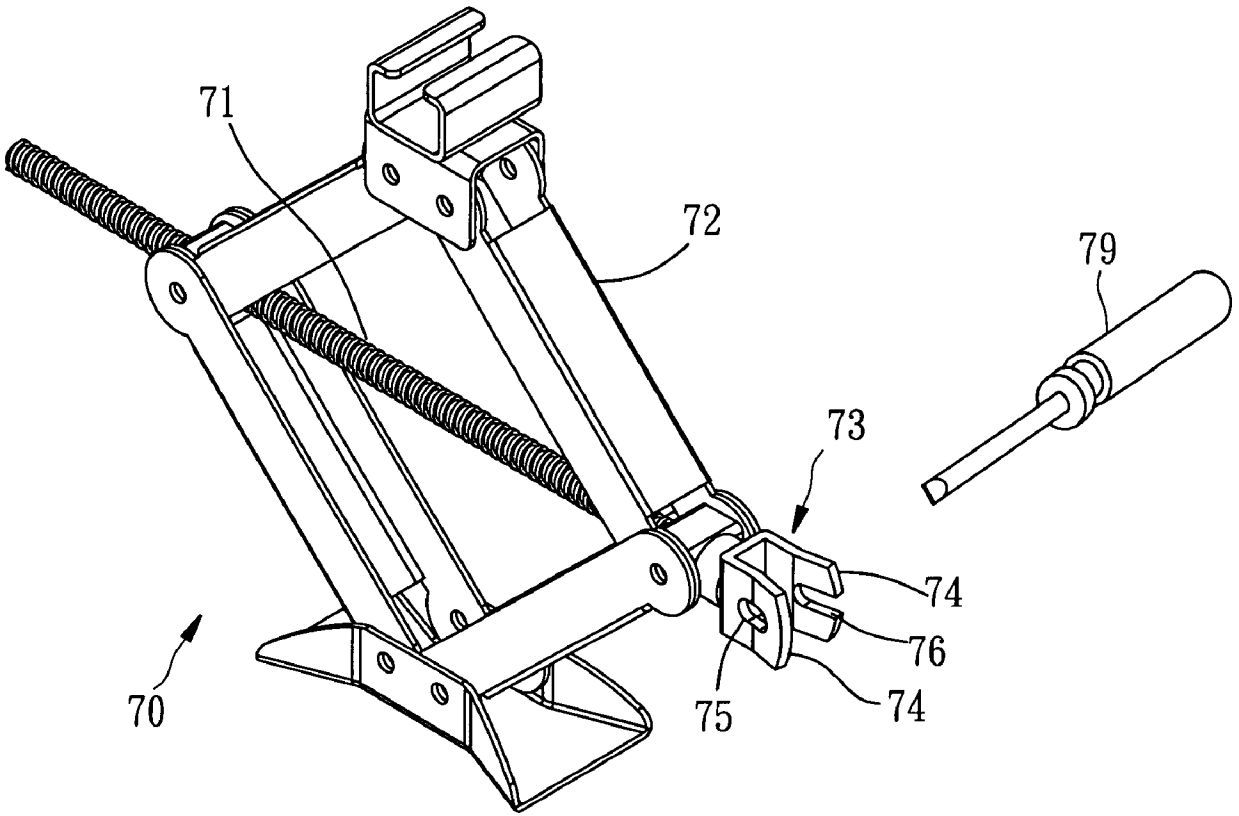
FIG. 6 PRIOR ART
FIG. 6 is a perspective view of a conventional jack in cooperation with a screwdriver for operation.

Referring to FIGS. 4 and 5, the ratchet-based adaptor assembly 60 constructed according to a second preferred embodiment of present invention is similar to the first preferred embodiment, but having difference as recited below.

The jack 66 in cooperation with the ratchet-like driven member 60 includes a flat rotatable joint 67 connected with the screw rod 68. The adaptor 61 has a flat socket 62 for fit with the rotatable joint 67 of the jack 66.

The operation of the present invention of the second preferred embodiment is similar to the first preferred embodiment but different because of the flat socket 62 of the ratchet-based adaptor assembly 60 which is fitted onto the rotatable joint 67.

As indicated above, the present invention is laborsaving and convenient for operation, and precludes the repeated insertion and extraction done by the user as the prior art. In addition, the user can have the hand located above the jack 56 without injury caused by rubbing the ground during the operation of the present invention.

Further, the adaptor 23 and the ratchet-like driven member 21 can alternatively be one-piece. The present invention is compatible with any currently commercially available jacks and wheel replacement wrenches to get rid of the costs incurred by purchase of specific jacks or wrenches.

What is claimed is:

1. A ratchet-based adaptor assembly for transitional connection between a jack and a wheel replacement wrench, said jack having a screw rod and a rotatable joint connected with said screw rod, said ratchet-based adaptor assembly comprising:

a main body having a circular hole;

a shell covered on said main body and having a neck protruding outwards from its external side, said neck having a rectangular socket, a receiving space being defined between said main body and said shell;

a ratchet-like driven member rotatably received in said circular hole and located in said receiving space, said driven member having a plurality of teeth at its periphery and an adaptor extending from its one side and out of said circular hole, said adaptor being provided for connection with said rotatable joint of said jack;

a switch member having at least two teeth for engaging said ratchet-like driven member and pivotally mounted to said main body and located in said receiving space and having a part exposed outside said main body; and a spring mounted between said main body and said switch member for generating resilience that keeps moving said switch member towards said driven member and enabling said switch member to engage said driven member.

2. The ratchet-based adaptor assembly as defined in claim 1, wherein said adaptor and said ratchet-like driven member are formed in one piece.

3. The ratchet-based adaptor assembly as defined in claim 1, wherein said rotatable joint of said jack further comprises two ears, one of said two ears having a slot, said adaptor of said ratchet-like driven member further comprises a flat body for being received between said two ears, said flat body having a lug protruding outwards from its one side for being wedged into said slot.

4. The ratchet-based adaptor assembly as defined in claim 1, wherein said rotatable joint of said jack is flat in shape; said adaptor of said ratchet-like driven member further comprises a flat socket at its external end for being fitted onto said rotatable joint.

* * * * *